US006167969B1

(12) United States Patent
Schoeffler

(10) Patent No.: US 6,167,969 B1
(45) Date of Patent: Jan. 2, 2001

(54) REMOTE CONTROL VALVE

(75) Inventor: William N. Schoeffler, Lafayette, LA (US)

(73) Assignee: Quantum Drilling Motors, Inc, Broussard, LA (US)

( * ) Notice: Under 35 U.S.C. 154(b), the term of this patent shall be extended for 0 days.

(21) Appl. No.: 09/215,936

(22) Filed: Dec. 18, 1998

(51) Int. Cl.[7] ..... E21B 34/10
(52) U.S. Cl. ..... 166/320; 175/38; 137/498
(58) Field of Search ..... 166/321, 323, 166/332.7, 332.1, 373, 386, 320; 175/38; 137/627.5, 498

(56) References Cited

U.S. PATENT DOCUMENTS 4,470,464 * 9/1984 Baldenko et al ..... 166/325
4,655,289 4/1987 Schoeffler .
5,957,207 * 9/1999 Schnatzmeyer ..... 166/332.1

* cited by examiner

*Primary Examiner*—Robert E. Pezzuto
(74) *Attorney, Agent, or Firm*—John D. Jeter

(57) ABSTRACT

The valve, has an orifice and cooperating poppet with the poppet situated to approach the orifice to an extent determined by a controlling crosshead that reciprocates axially in response to manipulation of the mud flow moving through the valve. The amount of restriction provided by the valve is varied by selected manipulation of the drilling fluid flow controls at the surface. Pressure provided to controlled machinery is regulated by a valve by-pass channel. Changes in the standpipe pressure indicates the state of the valve action achieved down hole.

3 Claims, 2 Drawing Sheets

REMOTE CONTROL VALVE

This invention pertains to a valve for use down hole on drill strings to control apparatus on the drill string that has drilling fluid powered functions with a plurality of optional operating characteristics. More specifically, the valve responds to drilling fluid flow controls manipulated at the surface to change the optional operating characteristics of apparatus controlled down hole.

BACKGROUND OF THE INVENTION

Drilling activities and other well bore related operations usually take place far below the earth surface and occasionally the nature of the operations need to be changed. In years past the drill string was simply removed down to the bottom hole assembly, and the needed changes were made, and the string was reinstalled in the well. Tripping the string became more costly and alternatives were sought, and found. The down hole assembly was made to respond to objects dropped down the drill string bore. Later the dropped objects were made recoverable without tripping the string. More recently, communication from the surface to the well bottom by way of manipulation of the drilling fluid flow rate accomplished what became known as down link command.

U.S. Pat. No. 3,967,680, issued Jul. 6, 1976, disclosed means to alter the state of down hole apparatus by the expedient of choosing between drill string rotation or mud flow as a first action after mud flow and drill string rotation had been stopped.

U.S. Pat. No. 3,896,667, issued Jul. 29, 1975, disclosed means to alter states of down hole apparatus by starting a mud flow rate below the flow rate used for drilling and maintaining that flow rate for a preselected length of time, say one minute, to change state down hole, before resuming the higher drilling fluid flow rate for drilling. When the apparatus down hole changed state, a pressure change signal, or pulse, was generated to indicate at the surface that the down hole change of state had been accomplished.

U.S. Pat. No. 4,655,289 issued Apr. 7, 1987, teaches the actuation of a selector valve responsive to manipulation of drilling fluid flow controls at the surface to alternately close and open the valve to divert fluid from the main fluid stream to power associated fluid powered down hole equipment. In using this valve, the associated equipment controlled had to have fluid handling capabilities with features that accommodated the valve design.

With down link command readily available, the opportunity to use changeable features on the bottom hole assembly was used to evolve apparatus capable of various measurement and control functions near the drill head. Such down hole assets are now in the market place. Most have fluid handling features that require particular characteristics, especially operating pressure and flow rate, of the control valves designed to regulate their activity.

There is a need for a remote control selector valve that is, itself, adaptable to present flow diverting capabilities to match the equipment to be served.

It is therefore an object of this invention to provide a selector valve that can be readily adapted to divert the amount of fluid, at a preselected pressure differential, ideally suited to the purpose to be served.

SUMMARY OF THE INVENTION

A valve, situated in the drill string bore, near the drill head, is actuated by manipulation of the drilling fluid flow rate at the surface. A valve poppet head is arranged to be urged by entrainment in the mud flow toward an orifice that will cooperate with the poppet head to inhibit the flow. The poppet head is carried by a control rod and is spring biased to urge it to move upstream. A crosshead on the rod is arranged to move along a serpentine path that progresses peripherally around the rod in response to induced axial excursions.

The serpentine path is a groove that is stationary relative to the drill string. The groove is shaped such that the crosshead is urged to rotate in a selected rotational direction when moving axially and approaching an axial travel limit such that the return axial movement engages the groove on a surface that moves the crosshead farther in the selected rotational direction. This is known as a walk around groove well known in the art of machine construction.

In the preferred embodiment, the entrained poppet approaches the orifice at about the speed of the flowing mud stream to reduce the erosion that results from valve throttling. The poppet leaves the orifice as a result of reduced mud flow such that the pressure drop across the orifice, and the resulting piston effect of the poppet, is overcome by the rod biasing spring. There is then little pressure differential across the valve and, hence, little erosion during the brief opening of the valve.

The valve provides power to controlled devices by providing a pressure drop across the orifice that can be tapped for any hydraulic purpose. To provide the pressure drop without stopping mud flow the poppet is provided with a by-pass bore, preferably along it's axis. The bore is preferably fitted with a standard drill bit jet nozzle that is removable. Bit jets are normally tungsten carbide and for any given outer diameter several nozzle diameters are available. By selection of nozzle diameters the pressure drop across the orifice can be selected in view of the drilling fluid flow planned. By providing the by-pass in the valve, no by-pass is required, for maintenance of mud circulation, in the equipment controlled. Further, failure of the equipment controlled by the valve cannot cut off the drilling fluid flow down the drill string bore. The by-pass feature makes the valve operable with a variety of controlled equipment. The probability of a sudden, and potentially catastrophic, shut down of the drilling fluid circuit is reduced.

BRIEF DESCRIPTION OF DRAWINGS

In the drawings wherein like features have similar captions.

DETAILED DESCRIPTION OF DRAWINGS

Figure 1:
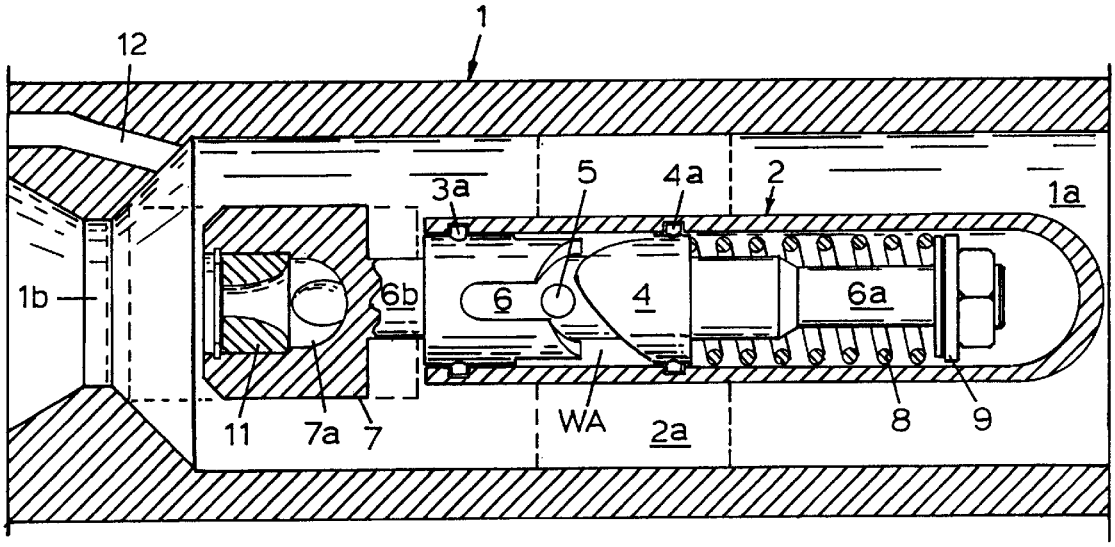
FIG. 1 is a side view, in cutaway, of the preferred embodiment of the invention.

In the drawings, some details that have no bearing upon points of novelty, and are well established in the art, are not shown in the interest of clarity and descriptive efficiency. Such omissions may include weld lines, some threaded junctions, pins, seal ring elements, and the like.

In FIG. 1 housing 1 is a part of a drill string with means (not shown) on opposite ends to attach to a continuing drill string, a bore 1*a* to conduct drilling fluid moving down the drill string, and a restriction 1*b*. Body 2 secured within bore 1*a* by spiders 2*a*, supports cam elements 3 and 4, houses spring 8, and operating arbor 6. Arbor 6 extends from the body as extension 6*b* to carry poppet 7 such that it can move to cooperate with orifice (restriction) 1*b* to function as a valve to impede the flow of drilling fluid (mud) along the drill string bore.

Cam elements 3 and 4 are secured to housing 4 by pins 3*a* and 4*a* at such positions that walk-around groove WA accepts crosshead pin 5 which extends through arbor 6 to project into the groove on opposite sides. Spring 8 acts against the top of element 4 and against the bearing 9 to urge the upper arbor extension 6*a* to the right, or upstream. The bearing 8 resists, but does permit, rotation of the arbor relative to the spring. The arbor will not rotate unless urged to do so by a significant torque.

Figure 2:
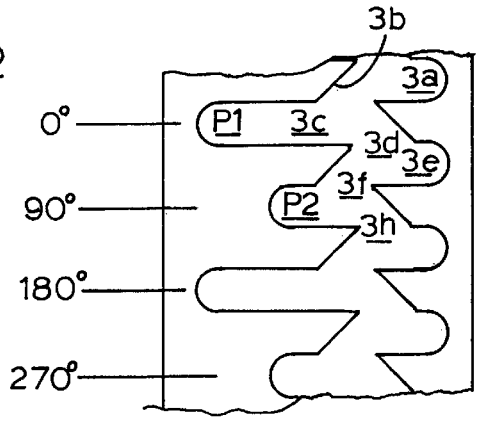
FIG. 2 is a surface development of an imaginary cylinder of such diameter that the walk-around groove layout is displayed as a plane.

Torque is applied to the arbor to cause it to progress rotationally as it moves along the groove passages. The grooves are shown in FIG. 2. There are two identical pin ends projecting 180 degrees apart but, for descriptive purposes, only one need be traced along the groove passages. Starting at groove position 3*a*, the rest state, the pin will move leftward when the poppet is entrained by flowing mud, to encounter the deflector part 3*b* of the groove. The arbor will rotate to allow the pin to move down groove extension 3*c* to the end P1. The end p1 is axially situated such that poppet 7 engages the bore restriction leading to orifice 1*b*. This will stop the mud flow not moving through bore 7*a* and the orifice of nozzle 11. The change in pressure drop through orifice 1*b* will be detectable at the surface as a change in standpipe pressure and it will provide hydraulic power for apparatus controlled by the valve. The hydraulic power is acquired by tapping the source channel 12 and relating the circuit to the lower mud pressure in bore 1*c*.

When mud flow is essentially stopped, the spring 8 will move the arbor upstream, opening the valve. Pin 5 will engage the deflector surface and move through opening 3*d*, rotating the arbor, and proceed to the rest position 3*e*.

When mud flow is restarted, the pin will move downstream to engage the aligned deflector surface and move through opening 3*f*, further rotating the arbor, and continue down shorter groove extension to position P2. As long as mud flow entrains the poppet with enough force to overcome spring 8, the pin will stay at the position P2. The axial position of position P2 is such that it stops the poppet some distance from the orifice and mud flow down the drill string is not significantly restricted by the valve.

When mud flow is again stopped the pin moves from position P2 and through opening 3*h* to repeat the process already described.

The program of pin movements through the walk around alternates the axial positions that open and close the valve. Obviously, there could be other schedules such as two closed positions spaced by one open position.

Figure 3:
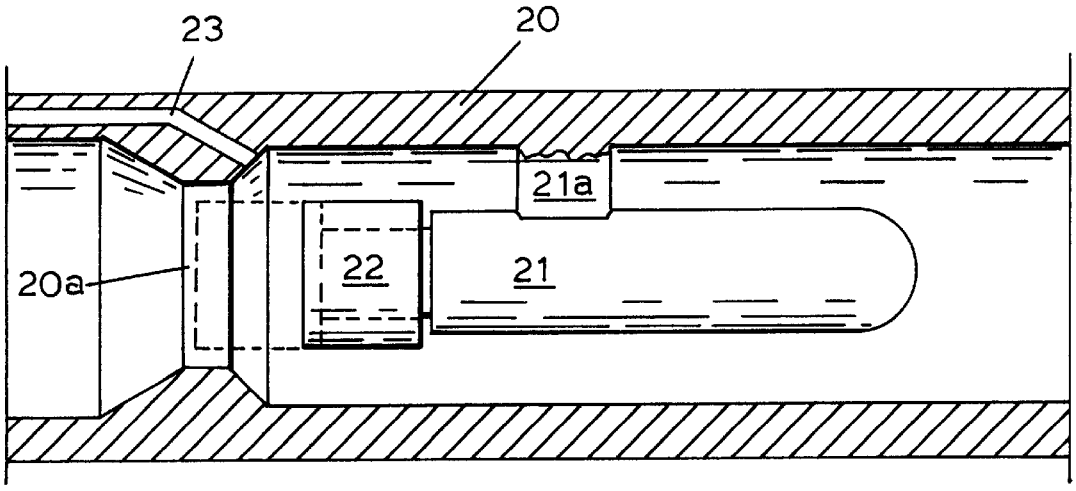
FIG. 3 is a side view, mostly cut away, of a selected area of the format of FIG. 1 showing optional features.

FIG. 3 shows an alternate form of poppet and orifice combination providing a by-pass channel that is formed of the peripheral area between the orifice 20*a* and the smaller poppet 22. Housing 20 and actuator 21 are similar to the same elements of FIG. 1, and similarly suspended in the bore by spiders 21*a*. Before the valve is actuated by processes already described herein, the poppet is stopped well above the orifice and does not influence pressure drop therethrough. When the poppet is lowered, as previously described for FIG. 1, it extends to, or partially through, the orifice to provide a restricted passage outside the poppet. The restriction is determined by the preselected diametric size relationship between the poppet and the orifice. The extent to which the poppet extends into the bore of the orifice has little effect upon the amount of restriction realized. Channel 23 conducts fluid at the preselected pressure to the machinery controlled.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. Apparatus for use in the bottom hole assembly on drill strings in earth bore hole operations which responds to manipulation of drilling fluid flow controls at the surface to alter the operational state of associated drilling fluid powered down hole equipment and provide a valve by-pass route for drilling fluid that is independent of said equipment, the apparatus comprising:

a) a housing arranged to function as a length element of a drill string, with a drilling fluid channel extending therethrough;

b) an orifice in said channel situated to accept at least part of a stream of said drilling fluid;

c) a poppet situated to move toward and away from said orifice to variably restrict the flow of said drilling fluid therethrough;

d) a channel through said poppet to provide said drilling fluid by-pass through said poppet and said orifice;

e) control means in said housing to move said poppet relative to said orifice in response to preselected manipulation of drilling fluid flow controls at the surface, said control means comprising a walk around contrivance with a fixed serpentine groove and movable cross head arrangement, said crosshead carrying said poppet, and responsive to axial movement of said poppet to move said crosshead in a preselected rotational direction along said groove, said groove including at least one axially extending groove portion which permits said poppet to engage said orifice to inhibit flow of said drilling fluid therethrough and at least one axially extending groove portion which permits said poppet to approach, but stop some preselected distance from said orifice.

2. Apparatus for use on fluid conducting drill string bottom hole assemblies to change the drilling fluid pressure available to fluid operated equipment in response to preselected manipulations of drilling fluid flow rates at the surface, the apparatus comprising:

a) a housing to function as part of a drill string, with a drilling fluid channel extending therethrough;

b) a restriction in said housing arranged to accept at least part of a stream of said drilling fluid.

c) a poppet situated to move toward and spring biased to move away from said orifice to variably restrict the flow of said drilling fluid therethrough, said poppet situated to resist the flow of said stream to derive entrainment forces to move with said stream, with a by-pass fluid channel arranged to discharge fluid through said orifice;

d) a poppet carrier arranged to move in sympathy with said poppet toward and away from said orifice;

e) a walk around comprising a serpentine groove fixed in said housing and a cooperating crosshead, carried by said poppet carrier, such that axial movement of said poppet induces preselected rotational movement of said crosshead, said groove having at least one axial extension that permits said poppet to inhibit flow of said stream through said orifice, and at least one axial extension that allows said poppet to move axially toward and stop some preselected distance from said orifice.

3. The apparatus of claim 1 wherein said by-pass fluid channel through said poppet comprises an opening through said poppet to accept, and secure, an interchangeable nozzle insert.

* * * * *